US005409151A

United States Patent [19]

Freimark

[11] Patent Number: 5,409,151

[45] Date of Patent: Apr. 25, 1995

[54] BOTTLE ASSEMBLY FOR CARRYING LIQUIDS

[76] Inventor: Justin Freimark, 215 W. 88th St., Apt. 4G, New York, N.Y. 10024

[21] Appl. No.: 269,525

[22] Filed: Jul. 1, 1994

[51] Int. Cl.[6] ..... A45F 3/16

[52] U.S. Cl. ..... 224/148; 224/202; 224/257; 224/258; 24/3.4; 215/228

[58] Field of Search ..... 224/148, 172, 177, 202, 224/204, 205, 254, 257, 255, 272; 220/751, 212.5; 215/228; 248/102; 24/11 R, 3 B, 3 F, 3 M, 3 K

[56] References Cited

U.S. PATENT DOCUMENTS

| | | | |
|---|---|---|---|
| 860,794 | 7/1907 | Felts | 224/272 |
| 910,238 | 1/1909 | Shaw | 224/257 |
| 1,208,728 | 12/1916 | Bartlett et al. | 224/148 |
| 2,079,046 | 5/1937 | Schoeninger | 24/3 K |
| 2,441,115 | 5/1948 | Lambert | 224/204 |
| 2,884,173 | 4/1959 | Campbell et al. | 224/205 |
| 3,543,976 | 12/1970 | Ronald | 224/205 |
| 3,547,322 | 12/1970 | Dawson | 224/148 |
| 4,049,165 | 9/1977 | Goldhaft | 224/255 |
| 5,092,018 | 3/1992 | Seron | 24/3 B |
| 5,105,768 | 4/1992 | Johnson | 215/228 |
| 5,224,135 | 9/1993 | Nelson | 24/3 B |
| 5,305,934 | 4/1994 | Grey | 24/3 B |
| 5,328,069 | 7/1994 | Cohanfard | 224/148 |

FOREIGN PATENT DOCUMENTS

| | | | |
|---|---|---|---|
| 121328 | 5/1946 | Australia | 224/148 |
| 1350558 | 12/1963 | France | 215/228 |
| 8406703 | 7/1984 | Germany | 224/257 |
| 4012031 | 10/1991 | Germany | 224/251 |
| 13803 | of 1906 | United Kingdom | 224/257 |

*Primary Examiner*—Henry J. Recla
*Assistant Examiner*—Gregory M. Vidovich
*Attorney, Agent, or Firm*—Michael Ebert

[57] ABSTRACT

A bottle assembly functioning as a handsfree canteen for carrying a drinkable liquid such as mineral water. The assembly include a standard liquid containing bottle whose externally threaded neck is engaged by a screw-on cap having a small loop integral therewith. The loop is coupled by a retractable link to a shoulder, waist or neck strap or chain for carrying the capped bottle.

7 Claims, 2 Drawing Sheets

BOTTLE ASSEMBLY FOR CARRYING LIQUIDS

BACKGROUND OF INVENTION

1. Field of Invention

This invention related generally to field canteens for carrying liquids, and not particularly to a bottle assembly functioning as a handsfree canteen for the liquid.

2. Status of Prior Art

Soldiers, field workers and hikers make use of canteens to carry water and other potable liquids. The conventional canteen for this purpose takes the form of a metal or plastic flask having a removable cap, the flask being nested within a fabric case that clips onto a waist belt.

One usually fills a canteen with tap water, and though most tap waters are safe to drink, they are almost always chlorinated. And because tap waters are conveyed from their source through extended pipe lines which contain sediment and other impurities, their taste leaves something to be desired.

The growing modern interest in natural food and liquid products has led many individuals to confine their drinking water intake to bottled waters of high purity that are free of chlorine and other chemical-sterilizing agents that may be carcinogenic. Bottled waters sold under such well-known brand names as EVIAN and POLAND SPRING WATER originated in natural springs or wells, and other than beneficial minerals whose nature depends on the liquid source, the liquid is devoid of chemicals.

Jogging is now a highly popular exercise. Many joggers are committed to natural foods and liquids, for good nutrition as well as proper exercise is conducive to health and well-being. These joggers therefore eschew foods and liquids that include additives or preservatives. And it is for this reason that joggers often carry in their hands a standard bottle of pure water so as to replenish the loss of water resulting from exertion and perspiration.

It is awkward for a jogger to hand carry even a small bottle of mineral water. But since most joggers only wear a pair of shorts and a T-shirt, they have no pocket on these garments that can accommodate a bottle of water. And while it would be possible for a jogger to strap a conventional canteen onto his waist and fill this canteen with bottled mineral water, rather than tap water, few joggers will do so. The reason for this is that the components of a standard mineral water bottle are sterile and will not contaminate the liquid contents. But should one decant water from this bottle into a metal or plastic flask that is put to repeated use, there is no assurance that the flask and its screw-on cap are sterile.

In order to make it possible for a jogger or other individual to carry a standard beverage bottle, the Cohanfard U.S. Pat. No. 5,167,354 provides for this purpose a cover adapted to replace the screw-on cap on the bottle, the cover being joined to a shoulder strap.

The drawbacks of the Cohanfard arrangement is that the cover which replaces the screw-on cap of the standard bottle, is used repeatedly and may therefore not be sterile, whereas the cap which is applied to the bottle at the bottling plant is in sterile condition. Hence the user of the arrangement has no assurance that the cover will not contaminate the liquid contents of the bottle.

SUMMERY OF INVENTION

In view of the foregoing, the main object of the invention is to provide a bottle assembly functioning as a canteen for carrying a liquid such as mineral water.

More particularly an object of this invention is to provide an assembly that concludes a liquid-containing bottle whose externally-threaded neck is engaged by a screw-on cap having integral therewith a small loop.

A significant advantage of an assembly in accordance with the invention is that it leaves the jogger, hiker or other individual who carries the water bottle handsfree. When the individual wishes to drink from the bottle, he has only to unlink the cap from the strap and unscrew the cap from the bottle. Or he may instead unscrew the bottle from the cap, leaving the cap linked to the strap.

BRIEF DESCRIPTION OF DRAWINGS

For a better understanding of the invention, as well as other features thereof, reference is made to the following detailed description to be read in conjunction with the accompanying drawings wherein.

DESCRIPTION OF INVENTION

Figure 1:
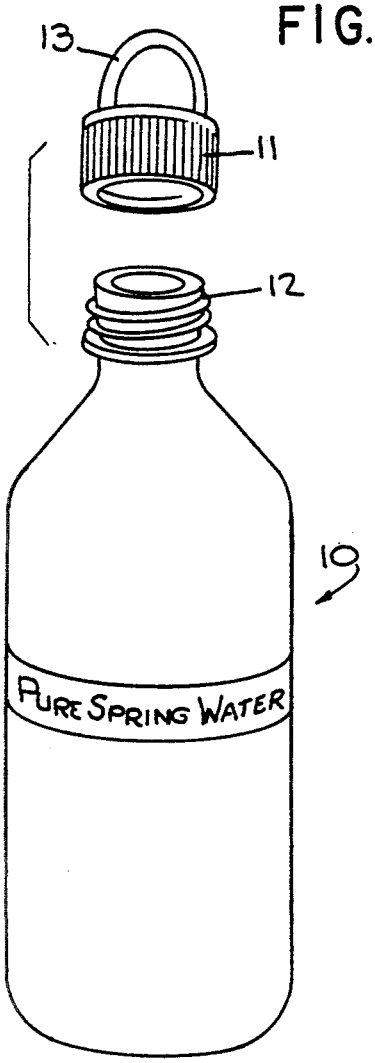
FIG. 1 illustrates in perspective a standard liquid-containing bottle and a screw-on cap therefor in accordance with the invention.

Referring now to FIG. 1, there is shown a standard bottle 10 containing pure mineral water of other drinkable liquid, and a screw-on cap 11 therefor which screw onto the externally-threaded cylindrical neck 12 of the bottle. Bottle 10 is fabricated of transparent synthetic plastic flexible material, such as polyethylene, which is non-reactive with the liquid contents. The diameter of neck 12 is appropriate to the internal diameter of the cap screwed thereon. Cap 11 is formed of rigid synthetic plastic material of high strength, such as polypropylene.

Integral with cap 11 and projecting therefrom is a small loop 13 formed of the same material of the cap and inseparable therefrom.

Figure 2:
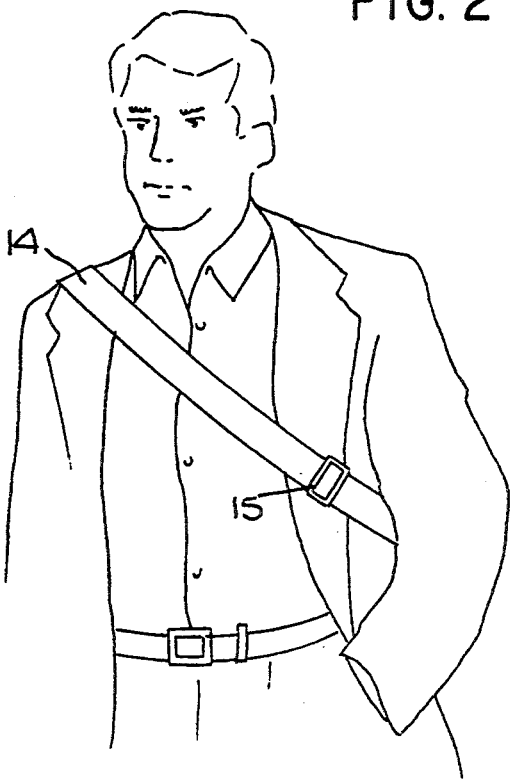
FIG. 2 is a front view of an individual wearing a shoulder strap in accordance with the invention.
Figure 3:
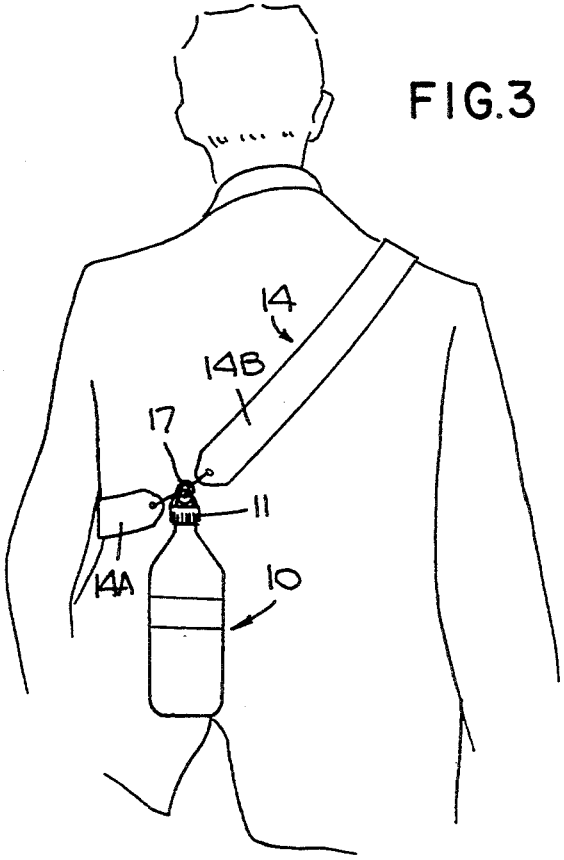
FIG. 3 is a rear view of the shoulder strap linked to the cap of the water bottle.
Figure 4:
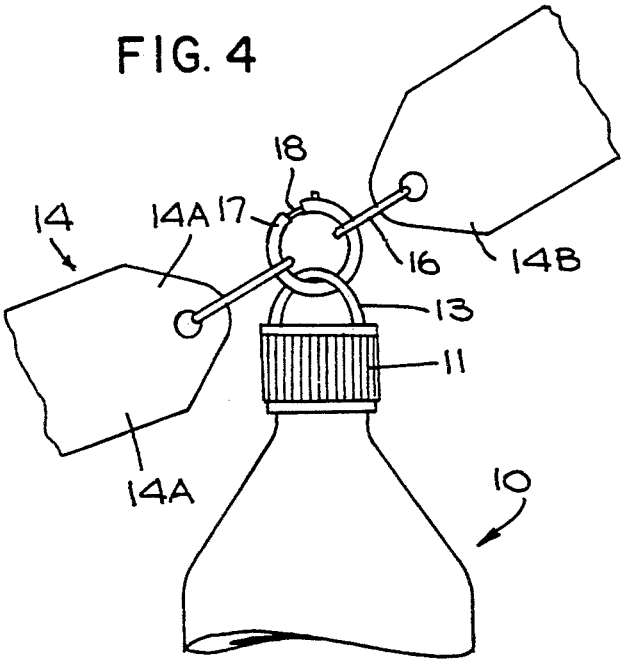
FIG. 4 shows the ends of the shoulder strap and the manner in which it is linked to the cap of the bottle.

As shown in FIGS. 2, 3 and 4, loop 13 on cap 11 is linked to a shoulder strap 14 formed of fabric or flexible plastic material and the strap goes over one shoulder of the wearer of the assembly in accordance with the invention and under the armpit below the other shoulder. The bottle in combination with the strap forms an assembly which makes possible a handsfree carrying of the water supply.

Strap 14, as shown in FIG. 2, is provided with a slide 15 through which a section of the strap is threaded to make it possible to adjust its length to conform to the wearer's requirements. The opposing ends 14A and 14B of the strap, as seen in FIGS. 3 and 4 are bridged by a short metal or plastic chain 16. Loop 13 of cap 11 is coupled to chain 16 by a retractable link 17.

Figure 5:
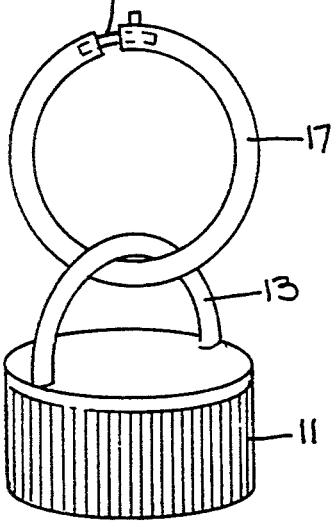
FIG. 5 is an enlarged view of the retractable link for coupling the cap to the shoulder strap.

Link 17, as shown separately in FIG. 5, is formed by the hollow metal ring having a spring-biased arcuate section 18 provided with an actuator pin, whereby when section 18 is retracted by the pin, it then telescopes within the hollow ring to create a gap to permit loop 13 on the cap to be received within the ring. When the arcuate section 18 is released, it then closes the gap to capture the loop within the link and thereby tie the cap to chain 16 of the strap 1 as shown.

The most convenient way of carrying bottle 10 on the shoulder strap while walking or jogging is to have the bottle dangle from the strap at the rear of the wearer, as shown in FIG. 3. But in practice the assembly may be worn to cause the bottle to dangle from the side or the front of the wearer.

In order for the user to drink from the bottle, he has only to unscrew the bottle from the cap, leaving the cap linked to the strap. After taking a drink, the user rescrews the bottle onto the cap. Or the user may prefer to detach the capped bottle from the strap by opening the link 17.

Figure 6:
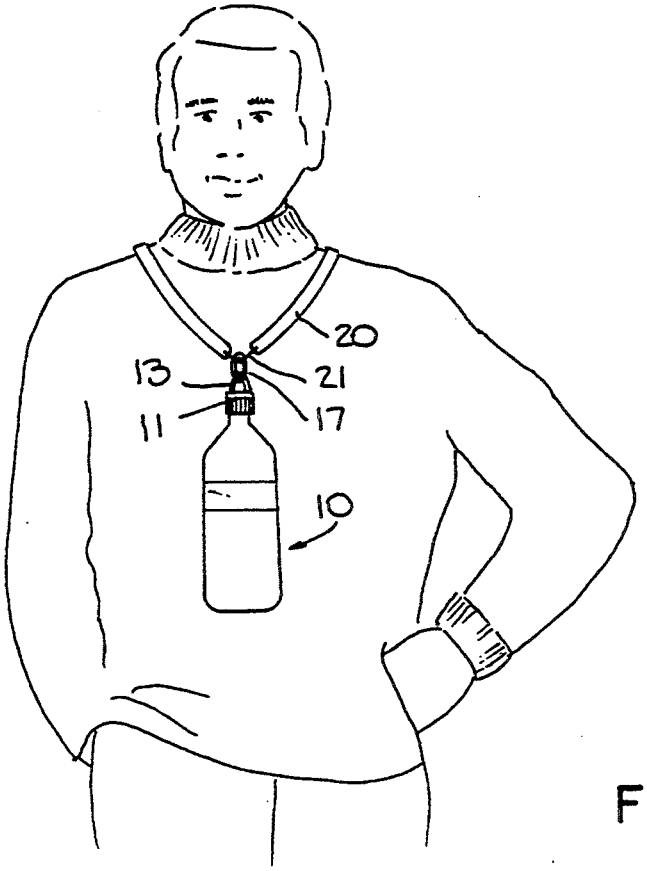
FIG. 6 shows a neck strap in accordance with the invention linked to the cap of the bottle.

The assembly is not limited to a shoulder strap in combination with a capped bottle, for as shown in FIG. 6, instead of a shoulder strap, use may be made of a neck strap 20 that is suspended from the neck of the user, the ends of neck strap 20 for being bridged by a chain 21 to which link 17 is coupled to suspend the capped bottle from the neck strap over the chest of the wearer.

Figure 7:
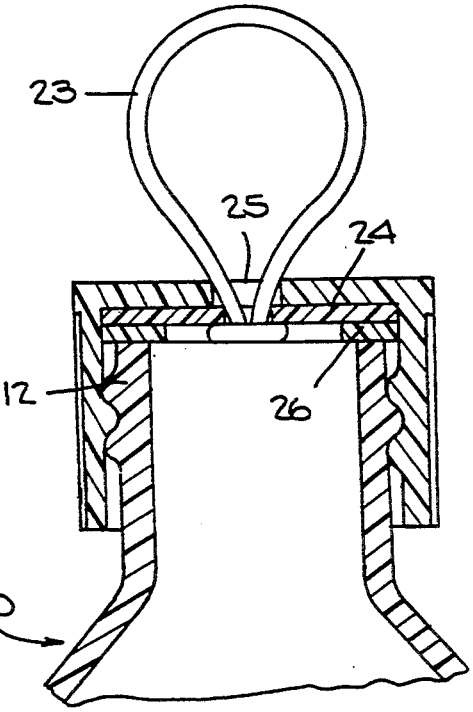
FIG. 7 shows another embodiment of the screw-on cap for the bottle.

In the embodiment of the internally-threaded cap shown in FIG. 7, the loop 23 projecting above the cap is formed of a short length of synthetic plastic filament or cable material whose opposing ends are anchored on a disc 24. Disc 24 is nested within the cap and this against the underside of the cap top wall which is provided with a center hole 25 to permit the ends of the cable to pass therethrough.

Pressed against the disc is a washer 26 of elastomeric material which when the cap is screwed on to the neck 12 of the bottle, then engages the end of this neck to prevent liquid from leaking through the cap.

This invention is not limited to the looped caps which are illustrated on the drawing, for in practice the cap for the bottle may be provided with a lug having a hole therein projecting from the top wall of the cap and anchored thereon to function as a loop. And the invention is not limited to an assembly that includes a neck strap or a shoulder strap, for in practice the strap may be a waist strap.

While there have been disclosed and illustrated preferred embodiments of a bottle and strap assembly in accordance with the invention, it is to be understood that many changes may be made thereon without departing from the spirit of the invention. Thus a bottle of water for a pet dog may be provided, the dog having a collar or neck belt that includes two retractable links, one connecting to the loop of the bottle cap, the other to the handle of a drinking mug for the dog.

What I claim is:

1. A bottle assembly functioning as a handsfree canteen for carrying a drinkable liquid, said assembly comprising:

A. a bottle containing liquid and having an externally threaded neck;

B. an internally-threaded screw-on cap received on said neck, said cap having a top wall provided with a projecting loop;

C. a strap wearable by a user of the assembly, opposing ends of the strap each having a small chain link connected, and D. a connecting link removably coupled to said loop and to each of said chain links whereby the capped bottle then dangles from the strap.

2. An assembly as set forth in claim 1, in which the strap is a shoulder strap.

3. An assembly as set forth in claim 2, in which the strap is provided with a slide to adjust its length.

4. An assembly as set forth in claim 1, in which the strap is a neck strap.

5. An assembly as set forth in claim 1, in which the bottle and the cap therefor are formed of synthetic plastic material.

6. An assembly as set forth in claim 5, in which the loop is formed of the same material as the cap and is integral therewith.

7. An assembly as set forth in claim 1, in which the loop is formed by a short length of flexible plastic cable whose opposing ends are anchored on a disc nested within the cap and laid against the underside of the top wall.

* * * * *